US005354970A

United States Patent [19]

Knupfer

[11] Patent Number: 5,354,970

[45] Date of Patent: Oct. 11, 1994

[54] POT FOR BATCH COATING OF CONTINUOUS METALLIC STRIP

[75] Inventor: Peter Knupfer, Aachen, Fed. Rep. of Germany

[73] Assignee: Inductotherm Corp, Rancocas, N.J.

[21] Appl. No.: 906,961

[22] Filed: Jun. 30, 1992

[51] Int. Cl.[5] ..... B23K 13/01

[52] U.S. Cl. ..... 219/609; 219/600; 219/635; 427/321; 373/151

[58] Field of Search ..... 219/10.65, 10.77, 10.69, 219/10.71, 10.75, 10.79, 609, 600, 634; 428/659, 684; 427/321, 349, 433, 45; 118/63, 67, 69; 373/142, 146, 159

[56] References Cited

U.S. PATENT DOCUMENTS

| | | | |
|---|---|---|---|
| 3,519,719 | 7/1970 | Fadler | 373/159 |
| 3,602,625 | 8/1971 | Duca | 373/142 |
| 3,779,056 | 12/1973 | Padjen et al. | 118/63 |
| 3,813,470 | 5/1974 | Duca | 373/142 |
| 3,887,721 | 6/1975 | Schwieterman | 219/10.65 |
| 3,977,842 | 8/1976 | Mayhew | 427/349 |
| 4,761,530 | 8/1988 | Scherer et al. | 219/10.71 |

FOREIGN PATENT DOCUMENTS

| | | |
|---|---|---|
| 59-129761 | 7/1984 | Japan . |
| 59-226166 | 12/1984 | Japan . |
| 662524 | 12/1951 | United Kingdom . |
| 753470 | 7/1956 | United Kingdom . |

OTHER PUBLICATIONS

Patent Abstracts of Japan, vol. 9, No. 96 (C-278) (1819) Apr. 25, 1985 & JP 59 226166 Dec. 19, 1984.

Patent Abstracts of Japan, vol. 8, No. 251 (C-252) (1688) Nov. 16, 1984 & JP 59 129 761 Jul. 26, 1984.

*Primary Examiner*—Teresa J. Walberg
*Assistant Examiner*—Tu Hoang
*Attorney, Agent, or Firm*—Seidel, Gonda, Lavorgna & Monaco

[57] ABSTRACT

A hot dip batch coating pot for containing a coating material in a liquid state. The pot comprises a container portion having a horizontal bottom and vertical side walls, with the bottom and said side walls defining an interior volume for containing said coating material. At least one coreless induction furnace is mounted on a side wall of the container portion. The coreless induction furnace defines an interior volume in communication with the interior volume of the container portion for inductively heating the coating material. The coreless induction furnace is disposed at an angle to the vertical.

13 Claims, 3 Drawing Sheets

12
14
16
18
20
22
24
26
28
30
32
34
36

POT FOR BATCH COATING OF CONTINUOUS METALLIC STRIP

FIELD OF THE INVENTION

The present invention relates to hot dip batch coating of continuous metal strip, and is particularly, but by no means exclusively, applicable to the coating of ferrous metals with zinc, aluminum and other coatings.

BACKGROUND OF THE INVENTION

In batch coating of ferrous metals, such as in batch galvanizing, parts to be coated are immersed into a bath of coating material after having been chemically pretreated and cleaned. The amount of time the parts stay immersed depends upon the material of the parts, their shapes, the bath temperature, the coating composition, and the desired coating thickness.

Batch coating is frequently used to coat continuous strips of ferrous base metal to produce iron or steel strip stock having a thin coating of zinc, aluminum or the like. In continuous-strip batch coating, the strip to be coated is first cleaned and pretreated, passed through a bath of molten coating material, and then withdrawn from the bath in a generally upward direction. The coating material adhering to the withdrawn strip is finished by coating rolls, air knives, or the like, and is subsequently solidified.

The molten coating material, usually a molten metal such as zinc, for example, is contained in an externally-heated iron or steel pot. Metal coating pots have several disadvantages, however. The have a relatively short life. This is due to several factors: rapid build-up of dross on the bottom of the pot, creep or bulging of the pot walls caused by the high temperature of the external heat source, and forces on the pot walls caused by the weight of the molten coating metal in the pot.

With regard to pot life, a distinction must be made between pot durability (failure of the pot as a result of local reactions between molten coating metal and the iron or steel wall of the pot) and the pot utilization period (dissolution of pot material into the molten coating metal). A long pot life primarily depends on the throughput rate of strip to be coated and on the temperature of the inside pot wall, but also depends on the pot material.

The external heating system and its design also have a great effect on pot life. Heating systems in use today with iron or steel pots include gas and oil-fired systems, as well as electric heating systems (either resistance heating or induction heating). Uniformly distributed heat input over the overall heating surface of the pot is a precondition for maximum utilization of the calorific power of coating pots for metallic coatings. Thus, a long pot life requires that several, often competing, demands be met:

- careful and uniform heating
- maintaining close temperature tolerances
- if zinc is the coating metal, maintaining the inside pot wall temperature at or below 480° C.

These demands are not always easily met in practice.

Another problem with batch coating is that the uncovered surface of the molten coating metal in the pot leads to the formation of oxides and dross at the surface of the molten coating metal. This is one of the most significant problems in hot dip batch coating. Upon emerging from the bath, the strip tends to pick up particles of dross and oxide from the surface of the bath, resulting in heavy edges of other imperfections in the coating applied.

One attempt to solve this last problem is disclosed in U.S. Pat. No. 3,887,721. That patent discloses a pot with a steel shell and a refractory lining, with an induction heating and stirring coil between the shell and the lining. The induction coil heats the molten metal bath and causes it to be continuously agitated so as to prevent dross accumulation on the bottom of the pot.

Although it does avoid the problems associated with conventional iron and steel coating pots, the solution proposed by U.S. Pat. No. 3,887,721 is less than ideal. By continuously stirring the molten metal bath, dross and oxides are kept in suspension and settle on the strip being passed through the bath, with the consequent undesirable effects on product quality.

The present invention provides a solution to the problem of how to avoid the problems associated with iron or steel coating pots while also avoiding the problems of dross and oxides being kept in suspension where they settle on the product and adversely affect its quality.

SUMMARY OF THE INVENTION

The present invention is directed to a hot dip batch coating pot comprising container means for containing a coating material in a liquid state. The container means has a horizontal bottom and vertical side walls, with the bottom and said side walls defining an interior volume for containing said coating material. The container has an interior lining of refractory material. At least one coreless induction furnace means is mounted on a side wall of the container means. The coreless induction furnace means defines an interior volume therein, the interior volume of the coreless induction furnace means being in communication with the interior volume of the container means for inductively heating the coating material. The coreless induction furnace means includes an induction coil having a central axis disposed at an angle to the vertical.

By locating the coreless induction furnace means in the side wall, above the bottom, oxides and dross are not kept in suspension by the inductive movement of the molten bath, and can settle down in the bottom part of the pot, where they do not become attached to the strip passing through the molten bath.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE INVENTION

Figure 1:
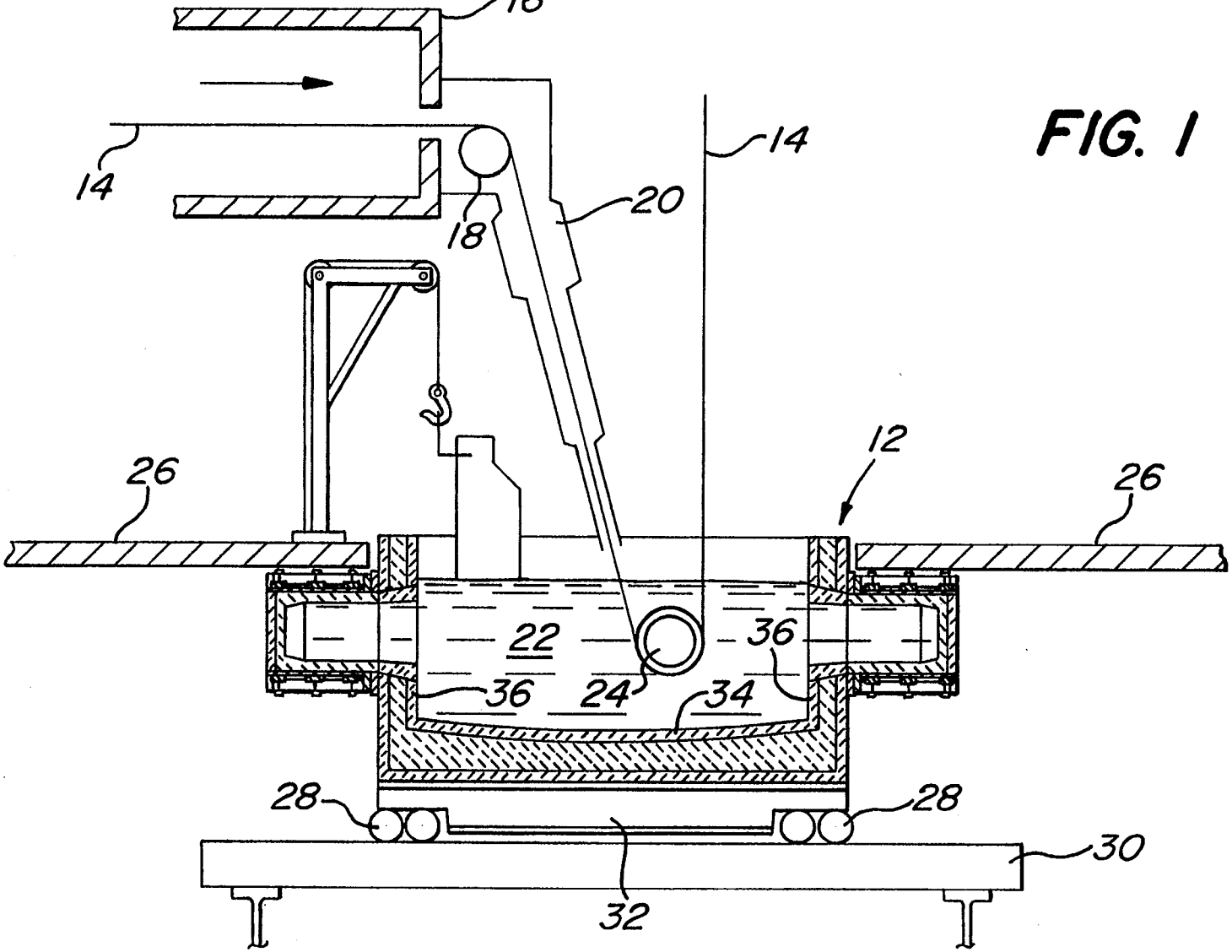
FIG. 1 is a schematic view of a hot dip batch coating installation incorporating a coating pot according to the present invention.

Referring now to the drawings, wherein like numerals indicate like elements, there is shown in FIG. 1 a schematic view of a hot dip batch coating installation 10 incorporating a coating pot 12 according to the present invention. Except for coating pot 12, installation 10 comprises conventional components well known to those skilled in the art. Accordingly, only a brief description of installation 10 is given.

Metal strip 14 to be coated is supplied to installation 10 from a treating furnace 16. Treating furnace 16 is used to pretreat strip 14 by, for example, heating to a sufficiently high temperature to burn off surface contaminants such as oil and the like from the surface of strip 14. Furnace 16 may also control the temperature of strip 14 for optimum coating. After exiting furnace 16, strip 14 passes over turn-down roller 18 and through a snout 20 into a bath of molten metal indicated generally by reference numeral 22. It will be seen that snout 20 extends into molten metal bath 22. This enables a desired atmosphere (e.g., a reducing or non-oxidizing atmosphere) to be maintained within snout 20 around strip 14 before it is immersed in bath 22.

After strip 14 is immersed in bath 22, it passes around a pot roller 24, which is suitably mounted for rotation within pot 12. Pot roller 24 is conventional. After passing around pot roller 24, strip 24 is withdrawn upward, in the direction shown by the arrows, by a conventional take-up device (not shown), where it may be coiled for storage and eventual use.

Preferably, but not necessarily, pot 12 is located substantially below a floor or deck 26. If desired, pot 12 may be provided with wheels or rollers 28 which operate on a track 30, so that a plurality of coating pots may be removable interchanged with installation 10. Wheels or rollers 28 may be part of pot 12, or may be mounted on a base assembly 32 on which pot 12 is set.

Pot 12 itself comprises a generally horizontal bottom 34 and generally vertical side walls 36. Bottom 34 and side walls 36 define a container having an interior volume for containing molten metal bath 22.

Figure 2:
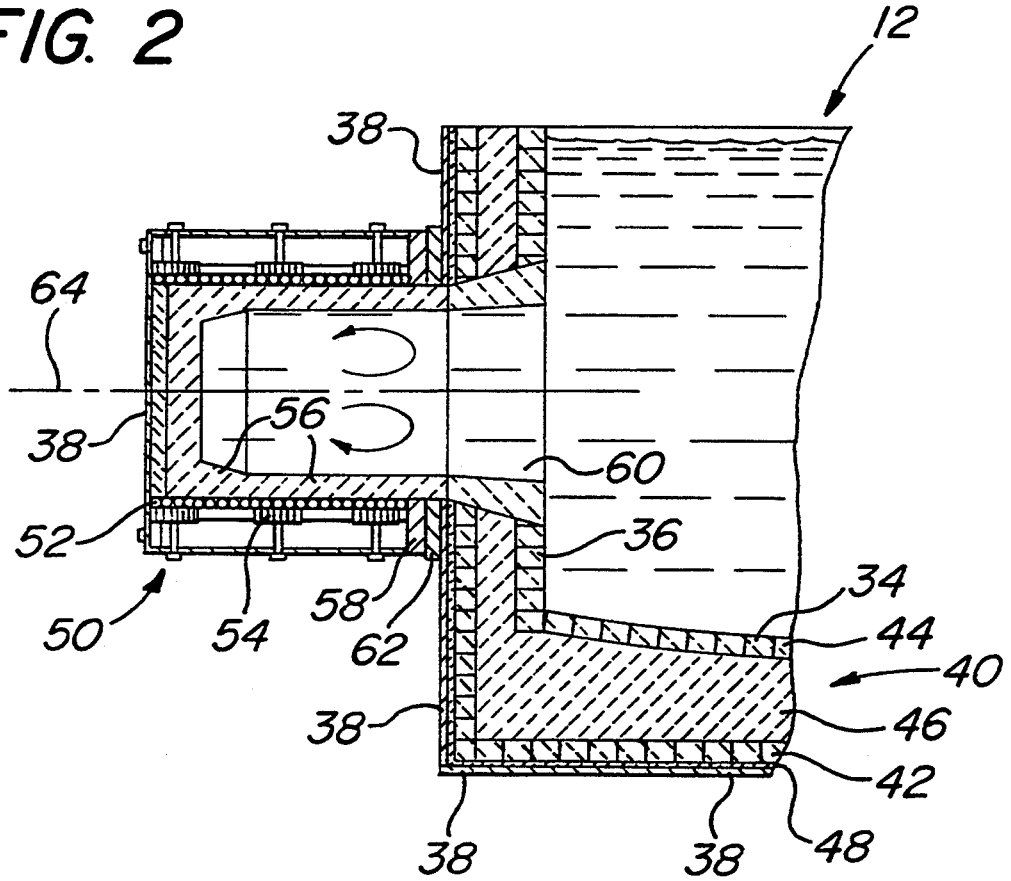
FIG. 2 is a partial sectional view, enlarged, of the coating pot illustrated in FIG. 1.

The construction of pot 12 itself is best seen in FIG. 2. Pot 12 comprises an outer steel shell 38, which may be a continuous shell but may also comprise a plurality of individual shell sections welded into a unitary structure. Shell 38 surrounds an inner refractory lining 40. Lining 40 is made up of a "cold face" layer 42 of refractory bricks adjacent shell 38, and a "hot face" layer 44, also of refractory bricks, which come into direct contact with the molten metal of bath 22. Between cold face layer 42 and hot face layer 44 is a layer 46 of a castable mix or a ramming mix, which forms a substantially monolithic intermediate layer between cold face layer 42 and hot face layer 44. Castable mixes and ramming mixes are the same in effect, and differ only in the way in which they are processed to form layer 46. An insulating layer 48 of insulating fiber, preferably an asbestos-free fiber, is installed between shell 38 and cold face layer 42.

At least one coreless induction furnace 50 is mounted in side wall 36 of pot 12. Induction furnace 50 is generally conventional, and comprises a generally helical water-cooled induction coil 52 and magnetic screening yokes 54 of sheet laminations. Within induction coil 52 is a crucible 56 of generally monolithic refractory material. Induction furnace 50 is attached to side wall 36 of pot 12 by any suitable means, such as flange 58, which surrounds an opening 60 in side wall 36. A high-temperature gasket 62 is provided between flange 58 and side wall 36 to seal opening 60 in pot 12 against leaks of molten metal from the interior of pot 12.

Figure 3:
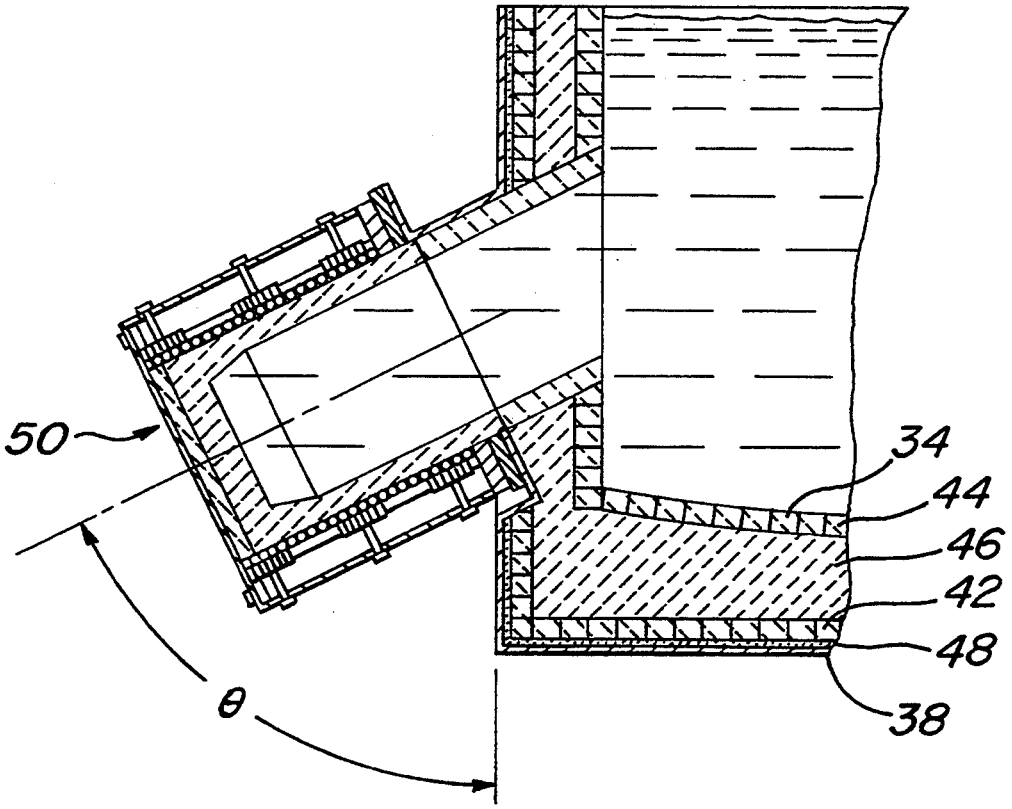
FIG. 3 is a partial sectional view of an alternate embodiment of a coating pot according to the present invention.

Induction furnace 50 has a central axis 64 which is disposed at an angle to the vertical. As shown in FIG. 2, the angle between central axis 64 of induction furnace 50 and the vertical is about ninety degrees. This enables easy emptying of induction furnace 50 when pot 12 is pumped out of molten metal. To this end, crucible 56 is given a slightly conical shape to facilitate emptying. However, other angles may be employed without departing from the scope of the invention. For example, as shown in FIG. 3, the angle $\theta$ between the axis and the vertical, as measured from the bottom of pot 12, may be substantially less than ninety degrees, such as forty-five degrees, for example.

In operation, alternating current at a defined frequency is applied to induction coil 52, in well-known manner. Induction coil 52 can be operated on either mains frequency or other frequencies. The power applied to induction coil 52 creates magnetic flux which passes through the coating material within pot 12 and within crucible 56, which acts as a single-turn secondary winding of a transformer, again in well-known manner. The flux passing through the coating material induces heavy secondary current in the material. These heavy secondary currents are converted into heat by the electrical resistance of the coating material. The secondary currents also provide a continuous stirring effect of the molten coating material within crucible 56, so that heat is transferred convectively to the material in pot 12 by movement of heated coating material from crucible 56 through opening 60 into the interior of pot 12.

The location of induction furnace is an important feature of the invention. The induction furnace must be attached to the side wall above the bottom of pot 12. Thus, the oxides and dross formed are not kept in suspension by inductive stirring of the bath 22, and can settle down in the bottom part of the pot. If the induction furnace were fitted to the bottom of pot 12, the oxides and dross would be whirled up over and over again and would settle on the surface of strip 14 as it passes through bath 22, adversely affecting the quality of the resulting coating.

Figure 4:
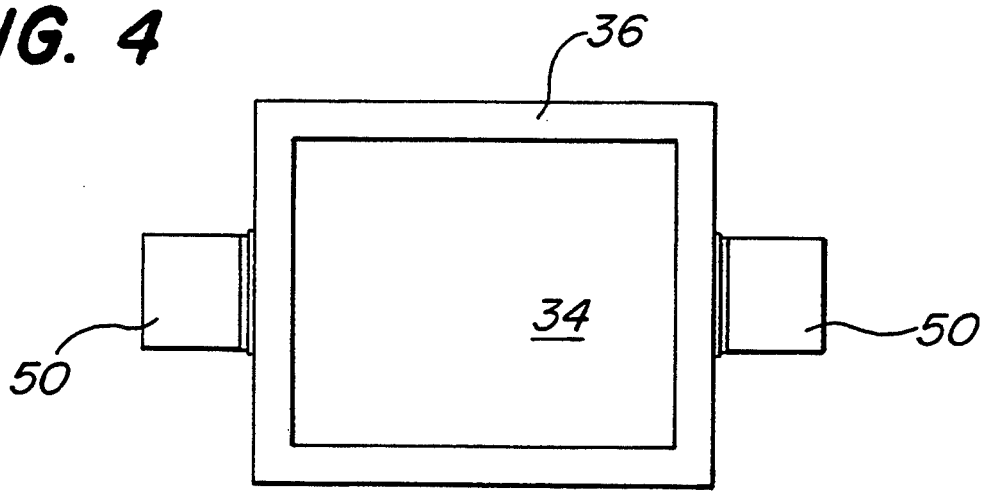
FIGS. 4, 5 and 6 are simplified top plan schematic views of additional embodiments of a coating pot according to the present invention.
Figure 5:
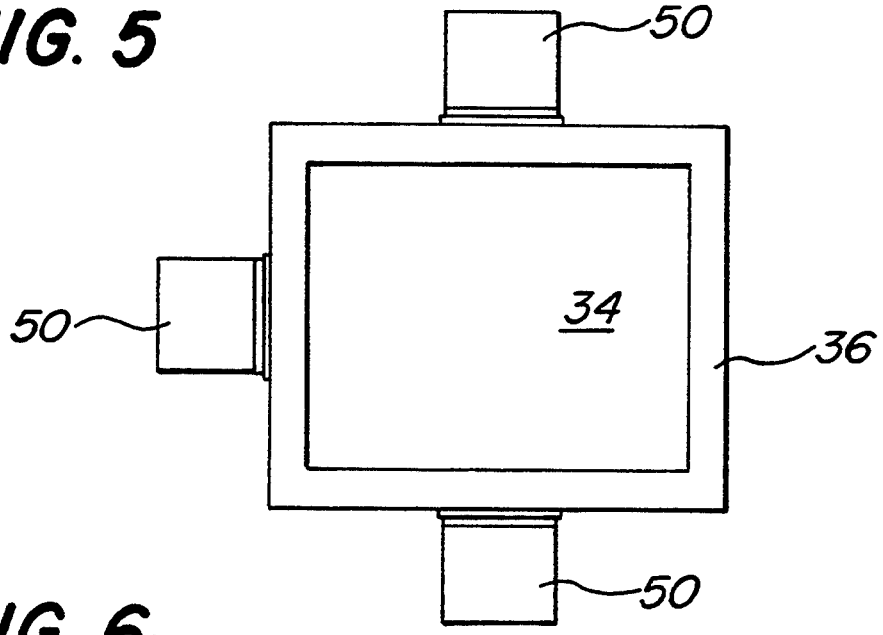
Figure 6:
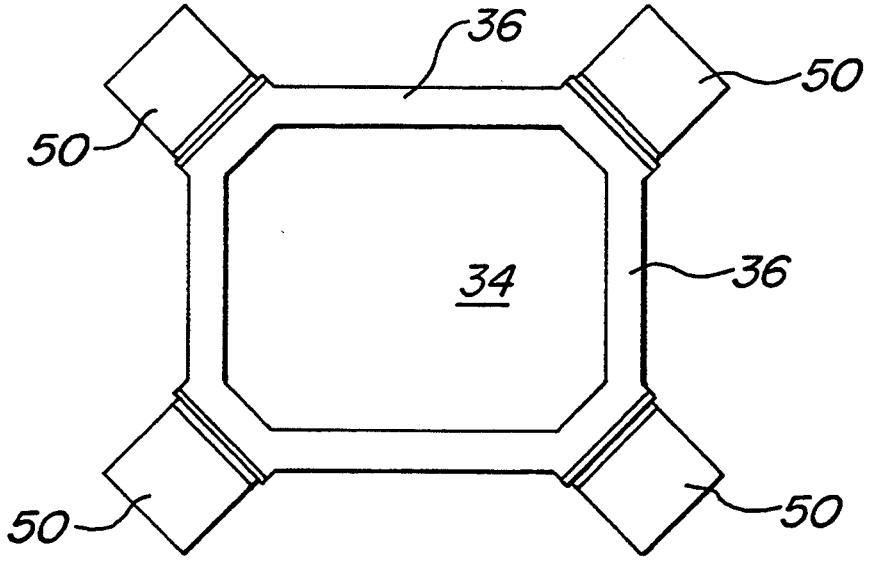

As shown in FIGS. 4 through 6, pot 12 may be fitted with one or more induction furnaces attached to the sides or to the comers between adjacent sides, without departing from the scope of the invention. A single induction furnace of a desired power rating may be used or, alternatively, as shown in FIG. 4, two induction furnaces, on opposite sides of pot 12, may be provided. Thus, the desired power rating may be split between two induction furnaces, which enables each furnace to be smaller and less expensive than a single large induction furnace of twice the power rating. The desired power rating may also be divided among three induction furnaces, as illustrated in FIG. 5. The more furnaces fitted to pot 12, the better the homogeneity of the molten bath.

Providing an induction furnace on each corner of pot 12, as illustrated in FIG. 6, enables better mixing of the molten metal, and thus more homogeneous temperature distribution in the bath.

The number of induction furnaces fitted to pot 12 depends primarily on the space available, which is a function of both furnace size (itself a function of desired power rating) and the physical size of the pot itself. For coating narrow strip, a small pot is desirable, which means that the available area for mounting induction furnaces will also be small. In such situations, mounting more than a single induction furnace on either side of the pot would be difficult. Of course, making a larger pot just to fit more induction furnaces would be self-defeating, because a larger pot means a larger bath surface and thus more heat lost by radiation.

The present invention has the additional advantage that, strictly speaking, the power rating available is virtually unlimited, so long as additional induction furnaces can be attached to pot 12.

The present invention may be embodied in other specific forms without departing from the spirit or essential attributes thereof and, accordingly, reference should be made to the appended claims, rather than to the foregoing specification, as indicating the scope of the invention.

I claim:

1. A hot dip batch coating pot comprising container means for containing a coating material in a liquid state, said container means having a vertical axis, an opening formed by a horizontal bottom and vertical side walls, said bottom and said side walls defining an interior volume for containing said coating material, said container means having an interior lining of refractory material, and at least one coreless induction furnace means mounted on a side wall of said container means, said coreless induction furnace means defining an interior volume therein, said interior volume of said coreless induction furnace means being in communication with said interior volume of said container means for inductively heating said coating material, said coreless induction furnace means including an induction coil having a central axis, said central axis being disposed at a right angle to the vertical axis.

2. A coating pot as in claim 1, wherein said refractory lining further comprises a layer of refractory brick in direct contact with the coating material in the container means.

3. A coating pot as in claim 1, wherein said angle is ninety degrees.

4. A coating pot as in claim 1, wherein said angle is less than ninety degrees when measured between said bottom and said axis.

5. A coating pot according to claim 1, wherein said pot comprises two induction furnace means mounted on opposite side walls, the interior volume of both of said induction furnace means being simultaneously in communication with said interior volume of said container means for allowing one or both of said induction furnace means to simultaneously inductively heat said coating material.

6. A hot dip batch coating pot comprising container means for containing a coating material in a liquid state, said container means having a horizontal bottom and vertical side walls, said bottom and said side walls defining an interior volume for containing said coating material, said container means having an interior lining of refractory material, and two coreless induction furnace means mounted on adjacent side walls, said coreless induction furnace means defining an interior volume therein, said interior volume of said coreless induction furnace means being in communication with said interior volume of said container means for inductively heating said coating material, said coreless induction furnace means including an induction coil having a central axis, said central axis being disposed at an angle to the vertical.

7. A hot dip batch coating pot comprising container means for containing a coating material in a liquid state, said container means having a horizontal bottom and vertical side walls, said bottom and said side walls defining an interior volume for containing said coating material, said container means having an interior lining of refractory material, and at least one coreless induction furnace means mounted on the corner between two adjacent side walls, said coreless induction furnace means defining an interior volume therein, said interior volume of said coreless induction furnace means being in communication with said interior volume of said container means for inductively heating said coating material, said coreless induction furnace means including an induction coil having a central axis, said central axis being disposed at an angle to the vertical.

8. A hot dip batch coating pot comprising container means for containing a coating material in a liquid state, said container means having a horizontal bottom and vertical side walls and being substantially rectangular in plan, said bottom and said side walls defining an interior volume for containing said coating material, said container means having an interior lining of refractory material, and a coreless induction furnace means mounted on each corner between adjacent side walls, said coreless induction furnace means defining an interior volume therein, said interior volume of said coreless induction furnace means being in communication with said interior volume of said container means for inductively heating said coating material, said coreless induction furnace means including an induction coil having a central axis, said central axis being disposed at an angle to the vertical.

9. A coating pot according to claim 1, wherein said coreless induction furnace means is mounted on the side wall above the bottom of the container means.

10. A coating pot according to claim 5, wherein said coreless induction furnace means are mounted on the side wall above the bottom of the container means.

11. A coating pot according to claim 6, wherein said coreless induction furnace means are mounted on the side wall above the bottom of the container means.

12. A coating pot according to claim 7, wherein said coreless induction furnace means are mounted on the side wall above the bottom of the container means.

13. A coating pot according to claim 8, wherein said coreless induction furnace means are mounted on the side wall above the bottom of the container means.

* * * * *